United States Patent [19]

Schmitt

[11] 3,972,338

[45] Aug. 3, 1976

[54] COIN CHANGER WITH DUAL-SLIDE PAYOUT MECHANISM

[75] Inventor: Donald E. Schmitt, Rockford, Ill.

[73] Assignee: Reed Industries, Inc., Rockford, Ill.

[22] Filed: Dec. 11, 1974

[21] Appl. No.: 531,657

[52] U.S. Cl. ..... 133/4 A
[51] Int. Cl.[2] ..... G07D 1/00
[58] Field of Search ..... 133/4 R, 4 A, 2

[56] References Cited

UNITED STATES PATENTS

| | | | |
|---|---|---|---|
| 3,132,654 | 5/1964 | Adams | 133/4 R X |
| 3,738,377 | 6/1973 | Lotspeich | 133/2 |

*Primary Examiner*—Drayton E. Hoffman
*Assistant Examiner*—Francis J. Bartuska
*Attorney, Agent, or Firm*—Leydig, Voit, Osann, Mayer & Holt, Ltd.

[57] ABSTRACT

Two reciprocating slides are biased toward payout positions and are adapted to discharge coins from separate storage tubes when the slides are moved to the payout positions. The slides normally are latched in home positions and are released in such a manner that either or both of the slides may move to the payout position during a payout cycle. As a result, a coin may be discharged from either one of the tubes or coins may be simultaneously discharged from both tubes during any given payout cycle.

2 Claims, 3 Drawing Figures

COIN CHANGER WITH DUAL-SLIDE PAYOUT MECHANISM

BACKGROUND OF THE INVENTION

This invention relates to a coin changer having a payout mechanism with two independently movable slides which are capable of moving past two storage tubes for coins of different denominations so as to pay out coins from the tubes. The payout mechanism is of the same general type as disclosed in U.S. Pat. No. 3,738,377. In such a payout mechanism, the slides are adapted to be latched in home positions. During each payout cycle, the appropriate one of the slides is unlatched and allowed to move to its payout position to discharge a coin from the associated storage tube, the other slide remaining in its home position. In this way, the changer can be made to pay out a coin of proper denomination by unlatching the proper slide and allowing such slide to move to its payout position.

SUMMARY OF THE INVENTION

The general aim of the present invention is to provide a coin changer having a new and improved dual-slide payout mechanism of the above general character which, during a payout cycle, is capable of paying out a coin from either one of the tubes or paying out coins simultaneously from both tubes. As a result, the changer lends itself to more flexible programming and, in addition, the storage tubes can be emptied more rapidly by a serviceman who wishes to inventory the number of coins in the tubes.

A more detailed object is to achieve the foregoing through the provision of a coin changer having a unique payout mechanism which includes means for releasing either or both of the slides for movement to the payout position during a payout cycle.

The invention also resides in the novel mounting of the slides for linear reciprocation and in the means for latching the slides in their home positions.

These and other objects and advantages of the invention will become more apparent from the following detailed description when taken in conjunction with the accompanying drawings.

DETAILED DESCRIPTION OF THE PREFERRED EMBODIMENT

Figure 1:
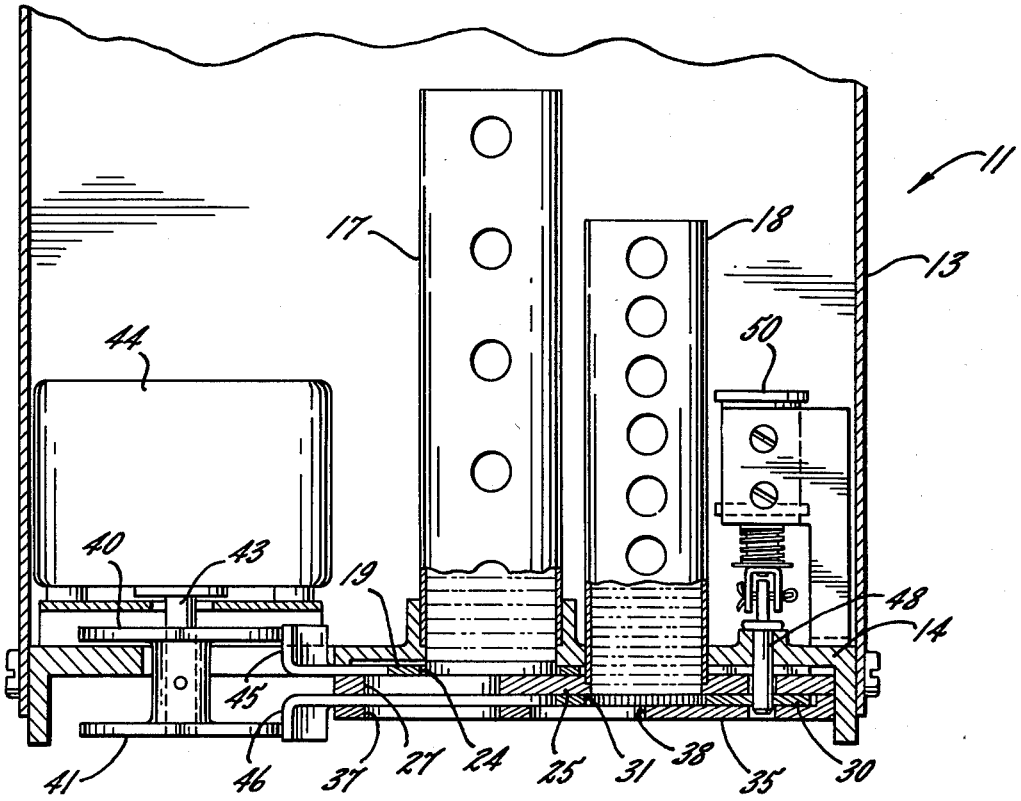
FIG. 1 is a fragmentary front elevation of a new and improved coin changer incorporating the unique features of the present invention, parts being broken away and shown in cross-section.

As shown in the drawings for purposes of illustration, the invention is embodied in a payout mechanism 10 for a coin changer 11 of the type which is capable of paying out change in coins of two different denominations when the sum deposited in the changer exceeds the vend price. The present changer accepts nickels, dimes and quarters and pays out change in the form of nickels and dimes. For example, when a quarter is deposited, the changer will pay out a nickel if the vend price is twenty cents, will pay out a dime if the vend price is 15 cents and will pay out a nickel and a dime if the vend price is 10 cents.

More specifically, the changer 11 includes a channel-shaped housing 13 within which the payout mechanism 10 is mounted. The payout mechanism comprises a main support or base 14 formed with holes 15 and 16 (FIG. 2) which receive nickel and dime storage tubes 17 and 18, respectively. Immediately underlying the base is a nickel payout slide 19 which is advantageously supported to move back and forth in a linear path from a home position to a payout position, the slide being biased toward the payout position by a contractile spring 20 connected between the upper side of the base and an upstanding ear 21 which projects upwardly through a slot 23 in the base. The nickel slide is formed with a hole 24 which registers with the nickel hole 15 in the base 14 and receives the lowermost nickel in the tube 17 when the slide is in its home position shown in FIG. 1. As the slide moves to its payout position (i.e., to the left in FIGS. 1 and 2), the lowermost nickel is moved along with the slide and falls downwardly from the hole 24 when the slide reaches its payout position. The slide then is returned reversely to its home position.

Located beneath the nickel slide 19 and fixed rigidly to the base 14 is a divider plate 25. The latter is formed with one hole 26 (FIG. 2) which is alined with the dime hole 16 in the base 14 and also is formed with another hole 27 which registers with the hole 24 in the nickel slide 19 when the nickel slide is in its payout position. The nickel slide 19 is formed with an elongated slot 29 which enables the dime tube 18 to extend downwardly into the hole 26 in the divider plate 25.

Figure 2:
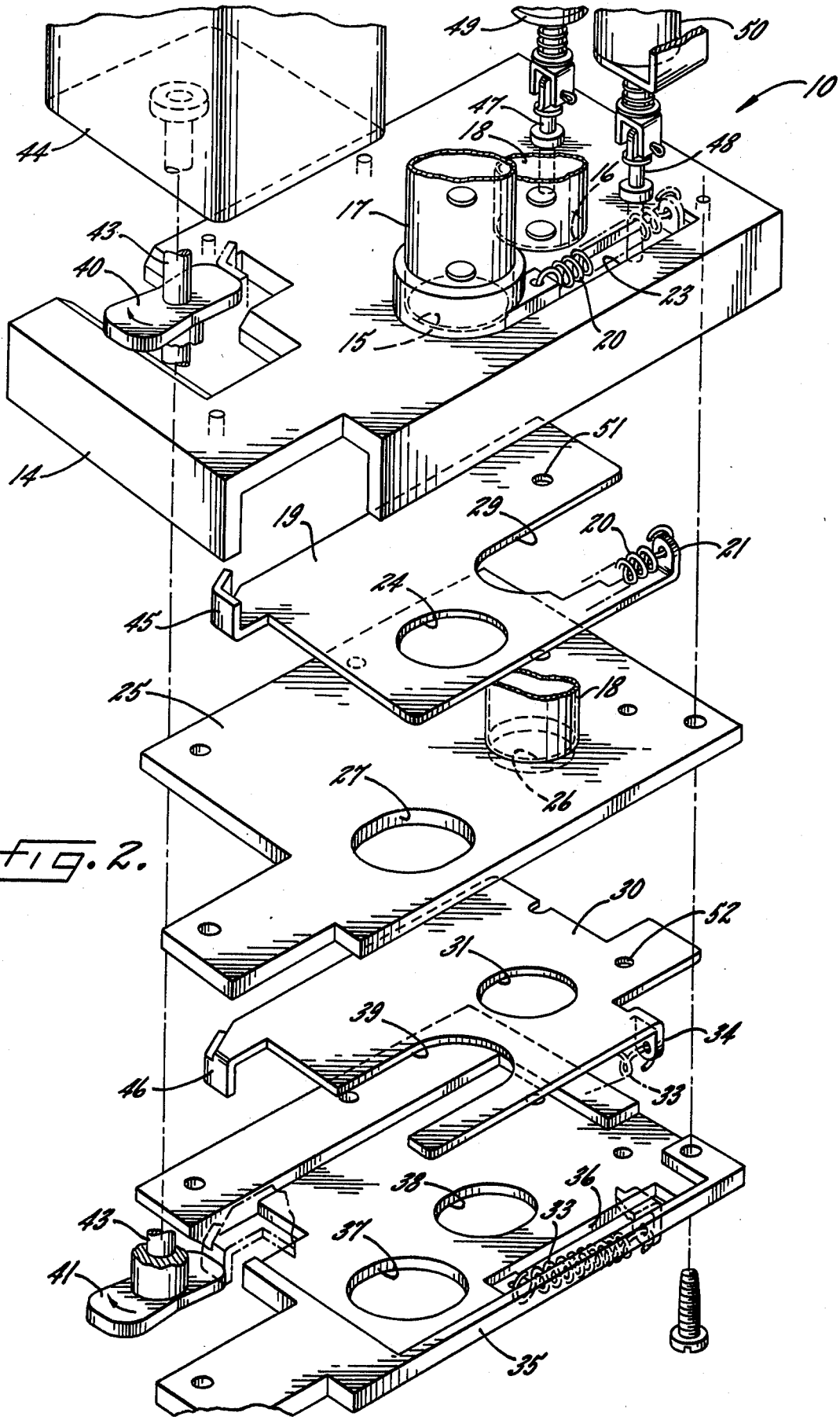
FIG. 2 is an exploded perspective view of parts shown in FIG. 1.

As shown in FIG. 2, a dime slide 30 underlies the divider plate 25 and, like the nickel slide 19, is mounted to move from right to left in a linear path from a home position to a payout position. When the dime slide 30 is in its home position, a hole 31 formed through the slide is alined with the dime tube 18 and receives the lowermost dime of the stack captivated by the tube. When the dime slide 30 is moved to its payout position, the dime drops out of the hole 31. Such movement is effected by a contractile spring 33 (FIG. 2) which is connected at one end to a depending ear 34 on the dime slide and at the other end to a stationary cover plate 35 which is located beneath the dime slide, the lug projecting downwardly through a slot 36 in the cover plate.

The cover plate 35 is fixed rigidly to the base 14 and is formed with a nickel hole 37 (FIG. 2) and a dime hole 38 which register with holes 24 and 31 in the slides 19 and 30, respectively, when the latter are in their payout positions. When the nickel slide 19 is in its payout position, an elongated slot 39 formed in the dime slide 30 enables the hole 37 in the cover plate 35 to communicate with the hole 24 in the nickel slide regardless of the position of the dime slide.

To control movement of the slides 19 and 30, two generally elliptical and angularly alined cams 40 and 41 (FIG. 2) are fixed to and spaced axially along the depending drive shaft 43 of a power actuated operator in the form of a small electric motor 44 which is supported on the upper side of the base 14. The cam 40 is directly engageable with an upstanding lug 45 on the nickel slide 19 while the cam 41 is directly engageable with a depending lug 46 on the dime slide 30. Prior to the beginning of each payout cycle, the cams are positioned with their long sides in engagement with the lugs. As the cams are initially rotated, the long sides of the cams move away from the lugs and release the slides 19 and 30 to the action of the springs 20 and 33. As the cams approach 180 degrees rotation to end the payout cycle, the opposite long sides of the cams bear against the lugs and return to the home position any slide which has been moved to its payout position by its respective spring. During the next payout cycle, the cams rotate through another one-half revolution to again release the slides to the action of the springs and then return any slide which has been moved to its payout position. As each slide moves to its payout position, it carries its coin to a location where the coin may drop through the hole 37, 38 in the cover plate 35 for return to the purchaser.

Movement of the slides 19 and 30 is further controlled in a unique manner which enables either or both of the slides to move to the payout position during a single payout cycle. In this way, the changer can be made to pay out either a single nickel or a single dime or the combination of both a nickel and a dime during any given payout cycle. Moreover, a serviceman wishing to empty the tubes 17 and 18 for the purpose of inventorying the coins therein may effect such emptying in a rapid manner by setting the changer such that both a nickel and a dime are discharged from the tubes during each payout cycle.

To achieve the foregoing, independently operable latches 47 and 48 (FIG. 2) are associated with the nickel and dime slides 19 and 30, respectively. Herein, the latches are in the form of plungers which are adapted to be reciprocated vertically between released and latched positions in response to the energization and de-energization of solenoids 49 and 50 mounted on the upper side of the base 14. When the slides are in their home positions and the solenoids are de-energized, the plunger 47 is urged downwardly into a hole 51 in the nickel slide 19 while the plunger 48 is urged downwardly into a hole 52 in the dime slide 30. Under these conditions, each slide is positively latched in its home position and neither can be moved to its payout position by its spring 20, 33 even though the cams 40, 41 are positioned to permit such movement.

Figure 3:
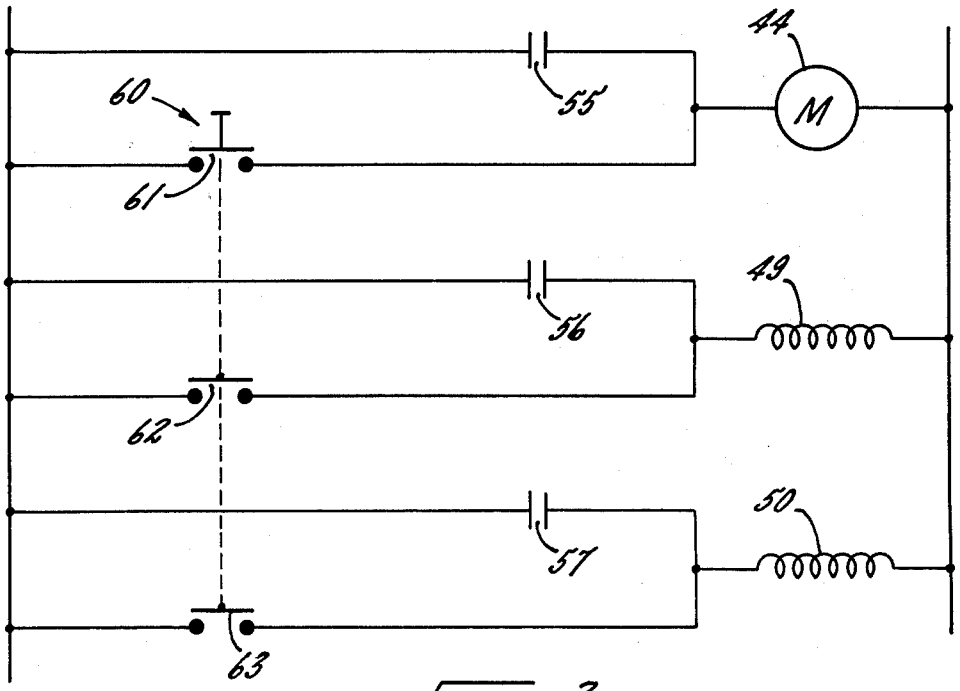
FIG. 3 is a diagram which shows, in greatly simplified form, the control circuit for the changer.

When a change making cycle is to be initiated, logic circuitry (not shown) associated with the changer 11 causes closing of the relay contacts 55 (FIG. 3) to energize the payout motor 44 and effect turning of the cams 40 and 41. Just prior to energizing the motor, the logic circuitry causes closure of either or both of two sets of relay contacts 56 and 57 associated with the solenoids 49 and 50, respectively, the contacts which are closed being dependent upon the amount of change to be returned as determined by the logic circuitry. If only the contacts 56 are closed, the solenoid 49 is energized to retract the plunger 47 from the hole 51 in the nickel slide 19 and permit movement of that slide to its payout position by the action of the spring 20. The solenoid 50 remains de-energized to hold the dime slide 30 in its home position and thus only a nickel is paid out during rotation of the cams 40 and 41 through their cycle of one-half revolution.

By the same token, closure of only the relay contacts 57 results in energization of the solenoid 50 and withdrawal of the plunger 48 from the hole 52 in the dime slide 30 so as to enable the spring 33 to move the dime slide to its payout position. Since the solenoid 49 remains de-energized, the nickel slide 19 remains latched in its home position by the plunger 47 and thus only a dime is paid out during rotation of the cams through one-half revolution.

When both sets of relay contacts 56 and 57 are closed simultaneously, both solenoids 49 and 50 are energized to release their respective slides 19 and 30. Accordingly, both slides move to their payout positions at the same time so that both a nickel and a dime are paid out during one-half revolution of the cams 40 and 41.

Rapid discharge of all of the coins in the tubes 17 and 18 may be effected by a serviceman simply closing a double-throw, triple-pole switch 60 whose contacts 61, 62 and 63 are connected in parallel with the relay contacts 55, 56 and 57, respectively. Closure of the switch 60 causes energization of the payout motor 44 and simultaneous energization of the solenoids 49 and 50 so that both slides 19 and 30 may move to their payout positions during each one-half revolution of the cams 40 and 41 and simultaneously pay out a nickel and a dime. As a result, the serviceman may cause both tubes to empty at the same time rather than waiting for one tube to empty before being able to empty the other tube. The serviceman thus may inventory the coins in a comparatively short time.

I claim as my invention:

1. A coin changer having a coin payout mechanism, said mechanism comprising a base, first and second coin storage tubes supported on said base, a first slide underlying said base and reciprocable back and forth in a linear path beneath said base from a home position to a payout position, said first slide having a first hole which is alined with said first coin tube when said first slide is in said home position and having a second hole which enables coins from said second tube to pass through said first slide when the latter is in either of said positions, a stationary divider plate underlying said first slide and having a first hole which is alined with the first hole in said fist slide only when the latter is in said payout position, said divider plate having a second hole which is alined with said second storage tube, a second slide underlying said divider plate and reciprocable back and forth in a linear path beneath said divider plate from a home position to a payout position, said second slide having a second hole which is alined with the second hole in said divider plate when said second slide is in said home position and having a first hole which enables coins from said first tube, said first hole in said first slide and said first hole in said divider plate to pass through said second slide when the latter is in either of said positions, a stationary bottom plate underlying said second slide and having a first hole which is alined with the first hole in said divider plate, said bottom plate having a second hole which is alined with said second hole in said second slide when the latter is in said payout position, each of said slides being operable when moved from its home position to its payout position to discharge a coin from its respective tube and through said bottom plate, means for biasing each of said slides from its home position to its payout position, a power operated cam means which is operable when actuated through one payout cycle to firt release said slides to the action of said biasing means and then to return to said home position any slide which has moved to said payout position, said cam means acting directly against and directly engaging said slides to return the slides, first and second latches associated with said first and second slides, respectively, and movable between latched and released positions to hold the respective slide in its home position and to free the slide for movement to its payout position, said first latch extending through said base and into said first slide, said second latch extending through said base, said first slide and said divider plate and extending into said second slide, and means operable to cause said first and second latches to both be in said released positions during actuation of said cam means through one payout cycle or to hold either one of said latches in said latched position while causing the other latch to be in said released position whereby either one or both of said slides may be moved to said payout position and discharge coins during actuation of said cam means through one cycle.

2. A coin changer as defined in claim 1 in which said last-mentioned means comprise first and second solenoids associated with said first and second latches, respectively, each solenoid being operable when changed to a different energized state to move its respective latch between its released and latched positions, and means operable to change both of said solenoids to a different energized state at substantially the same time or to keep either one of said solenoids remaining in its existing energized state while changing the other solenoid to a different energized state.

* * * * *